US009027705B2

(12) United States Patent
Furusawa et al.

(10) Patent No.: US 9,027,705 B2
(45) Date of Patent: May 12, 2015

(54) SOUND-ABSORBING MEMBER LAMINATION STRUCTURE

(71) Applicant: HOUSE 119 Inc., Fukuoka (JP)

(72) Inventors: Hidekazu Furusawa, Fukuoka (JP); Yasuya Kubota, Fukuoka (JP)

(73) Assignee: Aural Sonic Inc., Fukuoka (JP)

( * ) Notice: Subject to any disclaimer, the term of this patent is extended or adjusted under 35 U.S.C. 154(b) by 0 days.

(21) Appl. No.: 14/041,586

(22) Filed: Sep. 30, 2013

(65) Prior Publication Data

US 2014/0097038 A1 Apr. 10, 2014

Related U.S. Application Data

(63) Continuation of application No. PCT/JP2011/058944, filed on Apr. 8, 2011.

(51) Int. Cl.

| | |
|---|---|
| ***E04B 1/82*** | (2006.01) |
| ***E04B 1/84*** | (2006.01) |
| ***G10K 11/168*** | (2006.01) |
| *E04B 1/74* | (2006.01) |

(52) U.S. Cl.
CPC ..... *G10K 11/168* (2013.01)

(58) Field of Classification Search
USPC ..... 181/294, 290, 284, 291
See application file for complete search history.

(56) References Cited

U.S. PATENT DOCUMENTS

| | | | | |
|---|---|---|---|---|
| 4,594,278 | A * | 6/1986 | Nixon | 428/68 |
| 4,663,224 | A * | 5/1987 | Tabata et al. | 442/181 |
| 8,091,684 | B2 * | 1/2012 | Juriga | 181/286 |
| 8,365,862 | B2 * | 2/2013 | Coates et al. | 181/290 |
| 8,393,438 | B2 * | 3/2013 | Ogawa et al. | 181/290 |
| 8,496,088 | B2 * | 7/2013 | Kitchen et al. | 181/290 |
| 2002/0053484 | A1 | 5/2002 | Murakami et al. | |
| 2008/0245603 | A1 * | 10/2008 | Tinianov | 181/207 |
| 2009/0065299 | A1 * | 3/2009 | Vito et al. | 181/294 |
| 2009/0250292 | A1 * | 10/2009 | Hayasaka et al. | 181/290 |
| 2010/0170746 | A1 * | 7/2010 | Restuccia et al. | 181/290 |
| 2013/0209782 | A1 * | 8/2013 | Kipp et al. | 428/313.3 |
| 2014/0144722 | A1 * | 5/2014 | Lee | 181/290 |

FOREIGN PATENT DOCUMENTS

| | | | |
|---|---|---|---|
| JP | 05-187074 | A | 7/1993 |
| JP | 10-254452 | A | 9/1998 |

(Continued)

*Primary Examiner* — Edgardo San Martin
(74) *Attorney, Agent, or Firm* — Dingman, McInnes & McLane, LLP

(57) ABSTRACT

There is provided a sound absorbing member lamination structure in which the functions by the sound field adjustment can effectively be achieved by preventing the sound reflection against an intension of design in a boundary between the sound absorbing member and the other layer, when the sound absorbing member and the other layer are laminated into a united body. When the sound absorbing member and the other layer are placed in a stacked state, they are bonded with the use of a pressure-sensitive adhesive, so that the sound absorbing member and the other layer are combined together, with the pressure-sensitive adhesive kept uncured in a stacked state of the sound absorbing member and the other layer. Thus, such an uncured pressure-sensitive adhesive does not become a reflection portion of a sound. It is therefore possible to cause the sound to pass through appropriately the boundary between the respective layers.

4 Claims, 11 Drawing Sheets

(56) References Cited

FOREIGN PATENT DOCUMENTS

| | | | |
|---|---|---|---|
| JP | 11-003082 | A | 1/1999 |
| JP | 2001-207366 | A | 8/2001 |
| JP | 2002-082671 | A | 3/2002 |
| JP | 2002-169566 | A | 6/2002 |
| JP | 2006-030905 | A | 2/2006 |
| JP | 2009-287143 | A | 12/2009 |
| WO | 2011/013427 | A1 | 2/2011 |

* cited by examiner (A)

(B)

(A)

(B)

(A)

(B)

(A)

(B)

(A)

80Hz (B)

250Hz (A)

400Hz (B)

2000Hz (A)

80Hz (B)

250Hz (A)

400Hz (B)

2000Hz

SOUND-ABSORBING MEMBER LAMINATION STRUCTURE

RELATED APPLICATIONS

This patent application is a continuation of PCT/JP2011/058944 filed on Apr. 8, 2011, entitled "Laminate Structure of Sound Absorbing Material."

TECHNICAL FIELD

The present invention relates to a sound absorbing member lamination structure in which a plurality of members including a sound absorbing member and another lamination member are laminated to each other, while maintaining a state in which at least a part of sound may pass through at a boundary between the sound absorbing member and the other lamination member.

BACKGROUND ART

Neither consideration nor measures especially for reflection of a sound is usually taken in a room space of a room of a standard building or house. When a musical instrument player makes a practice of a musical performance or an inhabitant listens to music in such a room space, a peculiar reflection of sound may occur in the room space, and a reflected sound and a sound actually outputted from a musical instrument or acoustic equipment may come into ears of a human in a mixed state with each other.

As a result, a person in the room may often fail to listen to the original sound to be caused to listen to. There have conventionally been contrived various ways to improve such a situation to solve dissatisfaction with the sound.

There has conventionally been taken a way, as the most usual countermeasure to such a useless reflection of sound, of providing an object having a function of absorbing the sound without reflecting it on a ceiling or in front of a wall of the room, to cause it to absorb a part or whole of the sound generated from a sound source such as a music instrument, in order to inhibit an occurrence of a peculiar reflection of sound in the room space of a small room, thus inhibiting the useless reflection of sound.

An example of the sound absorber, which has conventionally been used for absorption of sound, is disclosed in JP 10-254452 A, JP 11-3082 A, JP 2001-207366 A, JP 2006-30905 A and JP 2009-287143 A.

CITATION LIST

Patent Literature

[Patent Literature 1] JP 10-254452 A
[Patent Literature 2] JP 11-3082 A
[Patent Literature 3] JP 2001-207366 A
[Patent Literature 4] JP 2006-30905 A
[Patent Literature 5] JP 2009-287143 A

SUMMARY OF INVENTION

Technical Problem

The conventional sound absorber is described in the respective patent documents as indicated above. When such a sound absorber is used, it was often used as a laminated sound absorption body in the form of a sheet or panel, through a combination of a plurality of layers including the sound absorbing member, as laminated into a united body, by combining a plurality of sound absorbing members to absorb the sounds in the different frequency ranges in a stacked state so as to cope with a sound absorption over a wide frequency range, or improve the sound absorbing member made of felt or the like, which has an inferior handling property alone, to provide an easy handling state in which it is combined with a substrate in the form of sheet or plate, or with a covering made of cloth, in view of the fact that use of a single sound absorbing member generally leads to a limited range of frequency of a sound which may be absorbed.

An adhesive agent is commonly used as a means to laminate these members such as the sound absorbing member, etc, into a united body in an easy manner. When the sound absorbing member is adhered to another sound absorbing member or a support layer by an adhesive agent, curing of the adhesive agent between the respective layers provides into a united body of the sound absorbing member and the objects to be adhered, thus ensuring a sufficient stability as a sound absorption body as laminated into a united body.

On the other hand, there has recently been proposed a system of sound field adjustment (articulation) which, in addition to a simple absorption of sound, permits to provide for example the similar acoustic property in a large room even in a small room, by adjusting appropriately a sound absorption state and a reflection state, and permitting reflection, taking into consideration the effects such as time delay, etc., due to the sound absorption for a favorable reflection sound component such as a harmonic sound relative to a basic sound of the musical instrument, while inhibiting the useless reflection of sound.

It is preferable to use a laminate obtained by laminating the sound absorbing members, etc. in order to achieve a sound absorption performance in a wide frequency range in response to a human hearing sense by a surface of sound absorption and to provide an easy handling, even in such a sound field adjustment. However, when the sound absorbing members are laminated by adhesion, the whole of the adhered portions between the respective layers, with a core of the adhesive agent as cured provides a rigid structure, with the result that such adhered portions serve as a kind of wall against a sound.

Thus, the adhered portions between the respective layers may substantially disable the sound from passing through and cause it to be reflected, and consequently, a useless component of the sound may be reflected by the adhered portions, causing a noise to be included in the reflected sound, unlike the envisaged results in a stage of design, and the adhered portions may inhibit an appropriate component of the reflected sound, which should fundamentally pass through them and be returned, from passing through them, leading to a state in which the reflected sound may not include such a component, thus causing a problem that such a laminate may not cope with an appropriate sound field adjustment.

In addition, the adhesive agent may cure so as to cover the surface of the sound absorbing member, and have an adverse influence on absorption of the sound by the sound absorbing member, thus leading to failure to provide a state in which the sound may appropriately be absorbed by the sound absorbing member. More specifically, it is not possible to provide the sound absorption effect, as normally envisaged, to attenuate the sound, while causing the sound to pass through the respective sound absorbing members, and accordingly the reflected sound from the sound absorbing members may include a component, which should normally be absorbed, such as a noise, or the level of the reflected sound for the respective frequency may become remarkably unstable, thus causing a problem that the laminate may not, after all, suitable for the sound field adjustment.

An object of the present invention, which was made to solve the above-mentioned problems, is to provide a sound absorbing member lamination structure in which a balance between the reflection and absorption of a sound can be ensured by the whole of the laminate as obtained and the functions by the sound field adjustment can effectively be achieved by preventing the sound reflection against an intension of design in a boundary between the sound absorbing member and the other layer as stacked, when the sound absorbing member and the other layer are laminated into a united body, and providing an appropriate absorption of sound by the sound absorbing member.

Solution to Problem

The sound absorbing member lamination structure according to the present invention, in which one or more sound absorbing member, and one or more interpositions and/or a surface covering are laminated into a united body, has features wherein: the interposition is in a form of a flexible thin sheet or a non-flexible thin sheet; the sound absorbing members, which are substantially in a form of a porous sheet, and the interposition are laminated by applying a pressure-sensitive adhesive composition, which is in a form of liquid and does not express an adherence property, on one or both of the sound absorbing member and interposition, and by placing the interposition between the sound absorbing members; and the pressure-sensitive adhesive composition as applied expresses the adherence property to convert into an intrinsic pressure-sensitive adhesive so that the pressure-sensitive adhesive adheres to each of the sound absorbing members and interposition to combine the sound absorbing members and interposition into a united body.

According to the present invention, when the sound absorbing member and the other layer are placed in a stacked state, they are bonded with the use of a pressure-sensitive adhesive, which expresses an adherence property later, so that the sound absorbing member and the other layer are combined together, with the pressure-sensitive adhesive existing between the sound absorbing member and the other member kept uncured in a stacked state of the sound absorbing member and the other member. Thus, the pressure-sensitive adhesive maintains an adherence property on the surface of the sound absorbing member so that such an uncured adhesive does not become a reflection portion of a sound, although the sound absorbing member for constituting the lamination structure is placed in a bonded state to the other sound absorbing member or the other part. In addition, the respective layers of the laminated structure as combined into a united body by the pressure-sensitive adhesive are not excessively restrained, thus permitting displacement or deformation between the respective layers due to a sound vibration, while maintaining integrity in a handling state. It is therefore possible to cause the sound to pass through appropriately the boundary between the respective layers, in which such displacement or deformation are permitted, and achieve, without any problems, the effect to absorb the sound by the sound absorbing member facing to the above-mentioned boundary. Thus, appropriate properties can be obtained for the whole of the laminate by an appropriate combination of the absorption and reflection of the sound, and the sound field adjustment can surely be achieved.

The sound absorbing member lamination structure according to the present invention may have, where appropriate, features that the interposition is formed extremely thinner than the sound absorbing member and has a plurality of through-holes formed at predetermined intervals, the through-holes having a larger size of an opening in comparison with a thickness of the interposition and enabling the sound absorbing members, between which the interposition is placed, to come into direct contact with each other; the pressure-sensitive adhesive composition is also provided on surface portions of the sound absorbing members, which overlap with each other in a position of the hole of the interposition in a laminated state; and the sound absorbing members are adhered into a united body in the position of each of the holes of the interposition in the laminated state.

According to the present invention, the interposition has through-holes with a larger size, so that, even in a case where the sound absorbing member is directly adhered in a position of the holes of the interposition, the sound absorbing members are bonded together, with the pressure-sensitive adhesive kept uncured, any hard portion, which may reflect the sound in the boundary between the sound absorbing members, is not formed, thus maintaining a state which permits the sound to pass through them. In addition, the pressure-sensitive adhesive does not inhibit the displacement or deformation of the sound absorbing member relative to the other sound absorbing member in the hole, and the absorption of the sound can be performed without any problem by the sound absorbing member, and especially the functions to adjust the passing-through of the sound or a reflection condition in the interposition through the hole can be achieved without inhibiting them, thus permitting to set appropriately the sound field adjustment state over the entire laminate. In addition, when the surface of the sound absorbing member is coated with the pressure-sensitive adhesive composition, the adhesion between the sound absorbing members in the holes of the interposition by the pressure-sensitive adhesive does cause no problem, and the pressure-sensitive adhesive composition may be applied on the entire surface without avoiding positions corresponding to the holes of the interposition, thus permitting to simplify the coating step of the pressure-sensitive adhesive and improve the working efficiency.

The sound absorbing member lamination structure according to the present invention may have, where appropriate, features that the sound absorbing member is formed of felt; and the pressure-sensitive adhesive composition has a degree of an adhesive power, which permits to maintain an adhered state to the sound absorbing member against a minimum pulling force, which is applied externally and permits to release combination of fiber elements constituting the sound absorbing member to exfoliate a part of the sound absorbing member.

According to the present invention, the pressure-sensitive adhesive provides an adhesive power, which may maintain an adhering state to the felt, also against the pulling force as applied externally, with an intensity permitting to release combination of the fiber elements constituting the felt serving as the sound absorbing member, i.e., combination by which the combined state of the felt is maintained, thus adhering the felt and the other layers together. Thus, even in a case where the pulling force as applied externally in a laminated state becomes large and the felt of the sound absorbing member may be partially peeled off for breakage, the breakage of the laminated layers does not occur from the base point of the pressure-sensitive adhesive, and the combined state by the adhesion may be maintained, and a combination state between the felt and the other layer may be maintained with a sufficient adhesive strength of the pressure-sensitive adhesive until at least the other portion of the felt is peeled off the pressure-sensitive adhesive applied portion of the felt. Consequently, the adhesive power of the pressure-sensitive adhesive can ensure an appropriate and sufficient strength over the whole of the laminate, since it is normally unlikely that a large force sufficient to break the sound absorbing member is applied externally.

The sound absorbing member lamination structure according to the present invention may have, where appropriate, features that a pressure-sensitive adhesive composition in a form of liquid is applied on the interposition when the sound absorbing members and interposition are laminated, to prevent the pressure-sensitive adhesive composition from penetrating into the sound absorbing member; and the pressure-sensitive adhesive, which has expressed the adherence property, is caused to exist between the sound absorbing members and interposition as laminated so as to be placed only in an outermost portion of a porous structure of the sound absorbing member.

According to the present invention, when the sound absorbing members and interposition are laminated, the pressure-sensitive adhesive composition in the form of liquid, which has not as yet expressed the adhesion property, is applied on the interposition, to prevent the pressure-sensitive adhesive composition from penetrating into the sound absorbing member, thus providing a state in which the pressure-sensitive adhesive exists only in the outermost portion of the sound absorbing member as stacked. Thus, although the sound absorbing member is combined together with the interposition through the pressure-sensitive adhesive, the pressure-sensitive adhesive exists in the outermost portion of the sound absorbing member, while maintaining the adhesive state, with the result, restraint of the sound absorbing members by the pressure-sensitive adhesive may be kept to the minimum necessity, thus making it possible to further improve a degree of freedom of displacement or deformation between the sound absorbing members due to a sound vibration, to achieve naturally the effect to absorb the sound even in a portion of the sound absorbing member, facing to the interposition, while maintaining surely an integrity between the sound absorbing members and the interposition in a handling state, thus improving the properties of absorption of the sound over the whole of the laminate.

DESCRIPTION OF EMBODIMENTS

Figure 1:
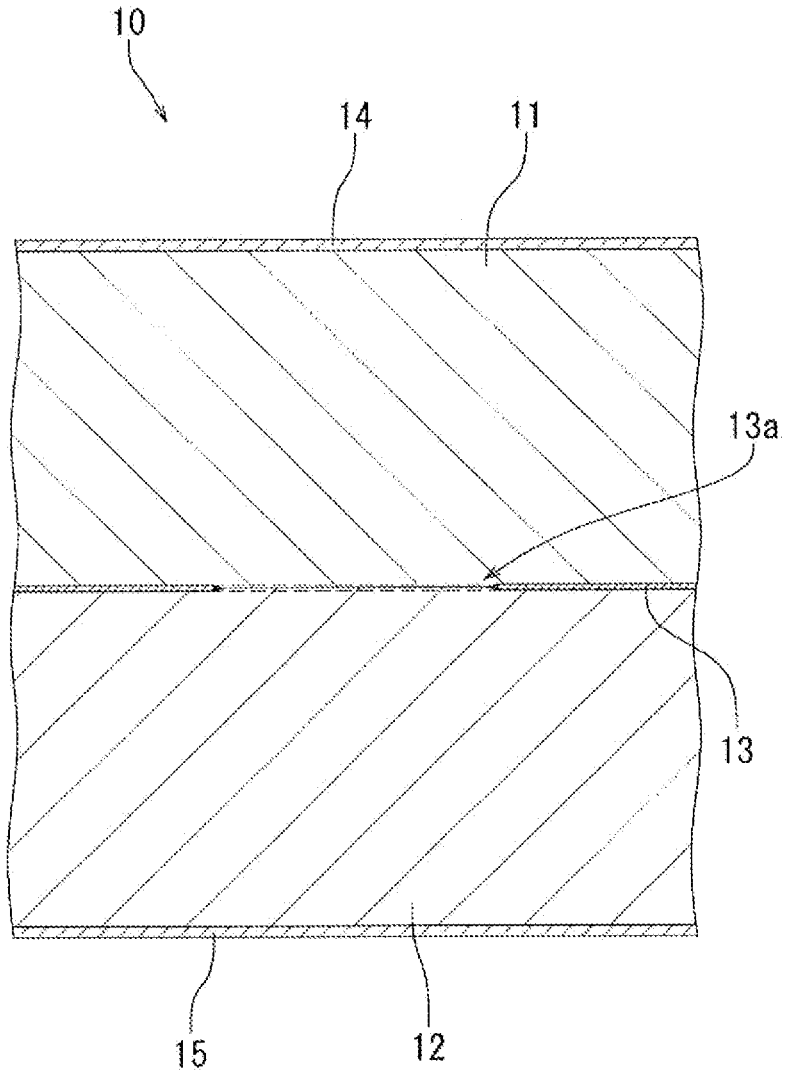
FIG. 1 is a sectional view of a sound absorbing member lamination structure according to an embodiment of the present invention.
Figure 2:
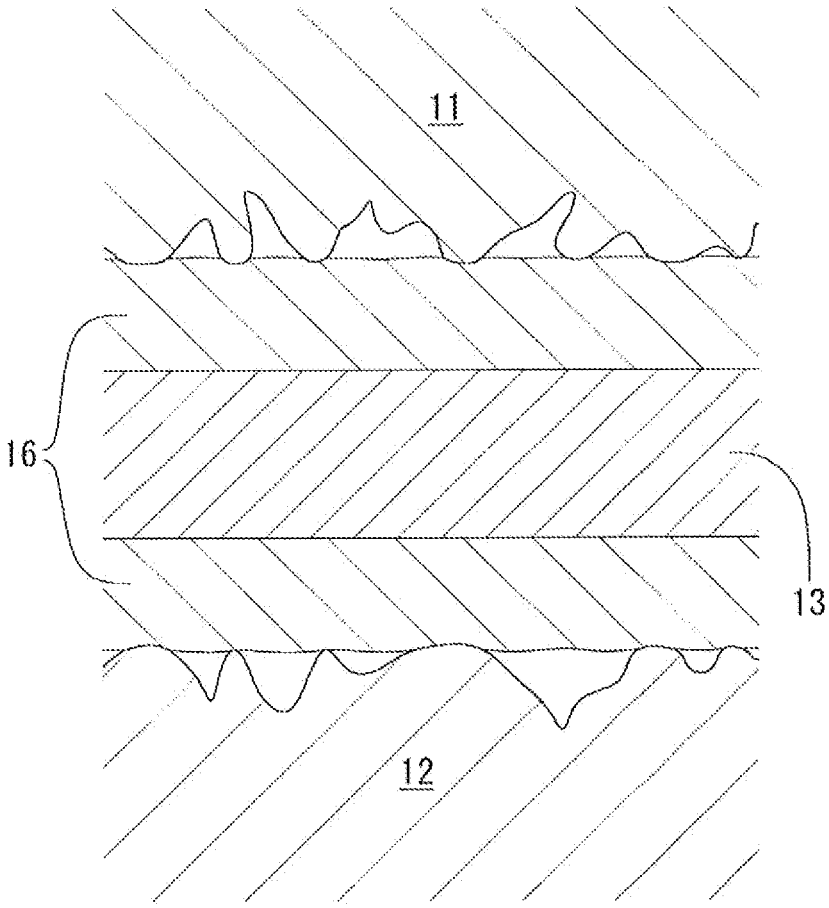
FIG. 2 is an enlarged sectional view of a boundary between a felt and an interposition of the sound absorbing member lamination structure according to the embodiment of the present invention.

Now, a sound absorbing member lamination structure according to the embodiment of the present invention will be described below with reference to FIG. 1 and FIG. 2 as indicated above.

In each drawings, the sound absorbing member lamination structure according to the embodiment of the present invention is a body obtained by laminating felts 11, 12 serving as the above-mentioned sound absorbing member, an (thin) interposition 13 in the form of thin sheet, which is placed between the felts 11, 12, and coverings 14, 15, which are formed of flexible material to cover the surfaces of the felts 11, 12, into a united body.

The above-mentioned felts 11, 12 are a known flexible porous body, which is obtained by combining natural fibers or synthetic fibers together into a sheet, and also have a resiliency by which it may be compressed slightly or restored in a direction of thickness thereof.

The thickness of the felts 11, 12 is set for example as about 10 mm. However, the present invention is not limited only to this value, the thickness may appropriately be selected in accordance with the material as well as the use as the sound absorbing member. The felts 11, 12 have not necessarily a uniform structure in their entirety in the direction of thickness thereof. More specifically, the felts 11, 12 may have a non-uniform structure in which they change in their property such as density in the thickness direction to provide a wider frequency range of sound that is capable of being absorbed by a single felt.

The felts 11, 12 for constituting the sound absorbing member are designed so that friction or the like caused between fiber elements in these layers during deformation permits to absorb energy of an external force for causing the deformation, i.e., sound.

The above-mentioned interposition 13 is formed substantially into an extremely thin sheet having flexibility. The thickness of the interposition 13 is set as a small value, which may be negligible relative to the thickness of the felts 11, 12 serving as the sound absorbing members, for example as about 0.1 mm. However, the present invention is not limited only to this value, the thickness may appropriately be selected in accordance with the material as well as the use as the interposition. The interposition 13 has a structure in which a plurality of through-holes having a larger size of an opening in comparison with the thickness of thereof, for example, a plurality of circular holes 13*a* having a diameter of 25 mm in case of the thickness of 0.1 mm, are arranged at predetermined intervals in longitudinal and transverse directions.

This interposition 13 and the felts 11, 12 are placed in a stack and adhered to each other by a pressure-sensitive adhesive. In the laminated state, the resiliency (bulk) of the felt itself, in addition to the possibility that a surface roughness or an unevenness of the felts 11, 12 in the position of the respective hole 13*a* of the interposition 13 may be larger than the thickness of the interposition 13, enables the parts of the felts opposing to each other in the hole 13*a* to come into direct contact with each other (see FIG. 1). Thus, the parts of the felts 11, 12 opposing directly to each other are bonded by the pressure-sensitive adhesive into a united body.

The above-mentioned covering 14, 15 are a thin sheet formed of cloth or resilient material, and have a resiliency to provide functions of covering the surfaces of each of the felts 11, 12 for protection, and causing the sound to pass through it and causing a part of the sound to be reflected by it.

The above-mentioned pressure-sensitive adhesive 16 does not express the adherence property as yet, and can be stocked or stored as an easy-handling pressure-sensitive adhesive composition. It has a chemical property of expressing the stable adherence property through loss of liquid component, after being applied to an object to be adhered and a lapse of the predetermined period of time, and being shifted or changed into a state in which it becomes the pressure-sensitive adhesive as intended. When for example an acrylic pressure-sensitive adhesive is to finally be obtained as the pressure-sensitive adhesive, there is used an aqueous emulsion of acrylic acid ester copolymer is used as the pressure-sensitive adhesive composition.

The above-mentioned pressure-sensitive adhesive composition has a chemical property of not permeating into the sound absorbing member, when applying it on the sound absorbing member formed of felt or the like, and not forming any film on the surface of the sound absorbing member, so that this composition exists in the outermost portion of the porous structure of the sound absorbing member and keeps this state even after bonding and exists between the sound absorbing member and the interposition.

When the felts 11, 12 and the interposition 13 are laminated into a united body, the pressure-sensitive adhesive composition, which is in a form of liquid and has not as yet expressed the adherence property, is applied on one or both of the felt and the interposition. In such a state, when the interposition 13 is placed between the felts 11, 12 for lamination, the pressure-sensitive adhesive composition expresses the adherence property between the felts 11, 12 and the interposition 13 after a lapse of the predetermined period of time and changes into a state in which it becomes the pressure-sensitive adhesive as intended, so that the felts 11, 12 and the interposition 13 are combined into a united body by the pressure-sensitive adhesive. It is preferable to use the pressure-sensitive adhesive having a strong adherence property as finally expressed, and to apply, when the felts 11, 12 and the interposition 13 are laminated, the pressure-sensitive adhesive composition only on the interposition 13.

In a state in which the pressure-sensitive adhesive exists between the felts 11, 12 and the interposition 13 and the adherence property has been expressed, the pressure-sensitive adhesive 16 has a degree of an adhesive power, which permits to maintain an adhered state to the felts 11, 12 against a minimum pulling force, which is applied externally and permits to release combination of fiber elements constituting the felts 11, 12 to exfoliate a part of them.

In such a laminate 10 as combined together, it is possible for the pressure-sensitive adhesive 16 to maintain surely the combined state by adhesion of the felts 11, 12 and the interposition 13 and ensure a sufficient strength for the whole of the laminate, until the felt itself cannot bear the pulling force, which is applied externally to the felts 11, 12 so that the other portion than the portion of the felt, which is adhered to the interposition 13 is peeled-off from the above-mentioned portion thereof to be separated from it, with the result that the laminate cannot maintain its shape.

The laminate as finally obtained, with the laminated structure of the felts 11, 12, the interposition 13, etc., is placed in a position where a useless reflection of the sound is to be restricted, around an object person who is to listen to the sound, relative to a sound source such as a musical instrument. Consequently, the sound that is to travel straight from the sound source toward the laminate, and/or the sound that has been reflected by a ceiling or wall is absorbed by the felts 11, 12, or a part of such a sound is reflected by the interposition 13 or the coverings 14, 15, thus permitting to carry out the sound field adjustment by which an arrival time of the other sound than the direct sound to the object person 80 may be remarkably changed.

Now, description will be given below of a lamination process of the respective components of the sound absorbing member lamination structure according to the embodiment of the present invention. First, the pressure-sensitive adhesive composition, which is in a form of liquid and has not the adherence property as yet, is applied on the whole of one surface of the interposition 13. Immediately after the rapid application on the whole surface, and before a part of the liquid component of the pressure-sensitive adhesive composition as applied on the interposition 13 is volatized to make the viscosity thereof higher, the felt 11 is placed on the interposition 13 on which the pressure-sensitive adhesive composition has been applied.

The above-mentioned pressure-sensitive adhesive composition is applied also on the other surface of the interposition 13. At this time, the pressure-sensitive adhesive composition is also placed on the surface portions of the felt 11, which are to be placed on the positions of the holes 13*a* of the interposition 13.

After applying the pressure-sensitive adhesive composition, the felt 12 is placed on the interposition 13 for adhesion. In addition, the pressure-sensitive adhesive composition is applied also on each of the coverings 14, 15, and the coverings 14, 15 are placed on the surfaces of the respective felts 11, 12. When the liquid component of the pressure-sensitive adhesive composition is volatized so that the pressure-sensitive adhesive, which has expressed the adherence property, is sifted into a state as intended, the respective layers between which the adhesive layer 16 exists becomes into an integrally bonded state in which the adhesion may prevent an easy separation, thus completing preparation of the laminate 10. In the positions of the respective holes 13*a* of the interposition 13 in such a laminated state, the felts 11, 12 between which the interposition 13 is placed are bonded together by the pressure-sensitive adhesive.

In addition, the pressure-sensitive adhesive composition is applied also on the other surface of the interposition 13 in the same manner, and the felt 12 is placed on it to cause the pressure-sensitive adhesive composition to migrate into the pressure-sensitive adhesive.

Further, the pressure-sensitive adhesive composition is applied also on each of the coverings 14, 15, and the coverings 14, 15 are placed on the surfaces of the respective felts 11, 12 to cause the pressure-sensitive adhesive composition to migrate into the pressure-sensitive adhesive, thus providing the laminate 10 in the finished state.

Now, description will be given of a used state of the laminate obtained by the lamination process. The laminate 10 is placed on a floor, a ceiling or a wall on the side of a room space of the room, where a useless reflection of sound is to be prevented. The felts 11, 12 which have a low strength, are laminated integrally with the other layers and the surface of the laminate is covered with the coverings 14, 15, thus ensuring a handling, without any problem, during an installation operation, and providing an easy installation.

In a state in which the laminate 10 has been placed, outputting the sound from the sound source for example by playing a music instrument by a player cause the generated sound to spread circumferentially, and the sound, which should normally have been reflected by the ceiling or wall in the room space, reaches the laminate 10 as placed.

When the sound has reached this laminate 10, the sound having some frequency ranges is first reflected by the covering 14, and the remaining sound passes through the covering 14. The sound, which has passed through the covering 14, reaches the felt 11, which is placed on an inner side, and a part of the sound is absorbed by this felt 11. The pressure-sensitive adhesive 16 in the adhesive region by which the felt 11 and the interposition 13 are bonded together, has not cured as yet, thus permitting deformation of both of them so as not to restrain excessively the adjacent portions, and preventing the sound from passing through to reflect the sound. Accordingly, the sound, which has passed through the felt 11, reaches the interposition 13 through the adhesive region.

A reflection of a part of the sound occurs on the surface of the interposition 13 as intended design in accordance with the properties of the interposition 13, on the one hand, and the remaining component of the sound, which has not been reflected, passes through the interposition 13 to reach the opposite surface.

The pressure-sensitive adhesive on the other surface of the interposition 13 has not also cured as yet, thus permitting deformation of the interposition 13 and the felt 12 by the sound and causing no reflection of the sound. Accordingly, the sound reaches to the side of the felt 12.

In addition, also in the holes 13*a* of the interposition 13, the pressure-sensitive adhesive 16 by which the felts 11, 12 are adhered directly to each other in such holes 13*a*, has not cured as yet and has bond the felts 11, 12 together. It is therefore possible to cause the sound to pass through without reflecting the sound at the boundary between the felts. In addition, the felts 11, 12 facing the holes 13*a* provide a sound absorption function without any problem, thus providing sufficiently the function of causing the sound to pass through the interposition 13 through the holes 13*a* and adjusting the reflection conditions.

The sound is further absorbed and attenuated when passing through the felt 12, and reaches the covering 15 on the opposite side to the side from which the sound is incident on, and a part of the sound may pass through to reach the outside and the remaining is reflected and then returned into the felt 12. The sound, which has reached the outside, is reflected by the ceiling or wall, which is placed behind the laminate 10, and a part of the reflected sound reaches the surface of the covering 15 of the laminate again, and the above-mentioned part passes through the covering 15 to reach the felt 12.

Each of the reflected sounds from the interposition 13 and the covering 15, as well as the reflected sound, which has once passed through the laminate 10 and then returned from the outside to the laminate 10 again, are further absorbed and attenuated when they pass through the pathway in the reverse direction to that as described above. A part of the sound, which has finally returned to the front side of the laminate, passes through the covering 14 and then is directed, as an extremely small amount of the reflected sound, to a person in the room space, i.e., a person who will listen to the sound from the sound source.

Thus, the part of the sound in an extremely small amount, which has not been absorbed by the laminate, may serve as the reflected sound to remarkably attenuate an energy of the sound, and reach the person with a partial time lag, and the person may listen to the direct sound from the sound source as well as the reflected sound of them.

A state in which the reflected sound having the energy of the sound as remarkably attenuated reaches to a person, together with the direct sound, becomes to the similar state in which, as if the sound is outputted from the sound source in a wide hall and a part of the sound is reflected by the reflection surface such as the ceiling or wall at a long distance and then reaches to a person.

This makes it possible to change a sound field based on the reflected sound having a large level including noises from the ceiling or wall, which is placed near the person, in a normal room space, to a sound field, which is very similar to a much wider space such as a hall than the normal room, in which space the ceiling or wall is placed sufficiently away from a person and the reflected sound may not substantially include noises or the like, and provide a person with the latter, thus remarkably improving an environment in which the person may listen to the sound with the appropriate sound field.

According to the sound absorbing member lamination structure of the present invention, when the felts 11, 12 and the interpositions 13, etc., are placed in a stacked state, they are bonded with the use of the pressure-sensitive adhesive 16, which expresses the adherence property later, so that the felts 11, 12 and the interpositions 13, etc., are combined together, with the pressure-sensitive adhesive 16 existing between them kept uncured in a stacked state of the felts 11, 12 and the interpositions 13, etc. Thus, the pressure-sensitive adhesive 16 maintains an adherence property on the surface of the felts 11, 12 so that such an uncured pressure-sensitive adhesive does not become a reflection portion of a sound, although the felts 11, 12 for constituting the lamination structure is placed in a bonded state to the interposition 13, etc. through the pressure-sensitive adhesive 16. In addition, the respective layers of the laminated structure as combined into a united body by the pressure-sensitive adhesive 16 are not excessively restrained, thus permitting displacement or deformation between the respective layers due to a sound vibration, while maintaining integrity in a handling state. It is therefore possible to cause the sound to pass through appropriately the boundary between the respective layers, in which such displacement or deformation are permitted, and achieve, without any problems, the effect to absorb the sound by the sound absorbing member facing to the above-mentioned boundary. Thus, appropriate properties can be obtained for the whole of the laminate 10 by an appropriate combination of the absorption and reflection of the sound, and the sound field adjustment can surely be achieved.

Figure 3:
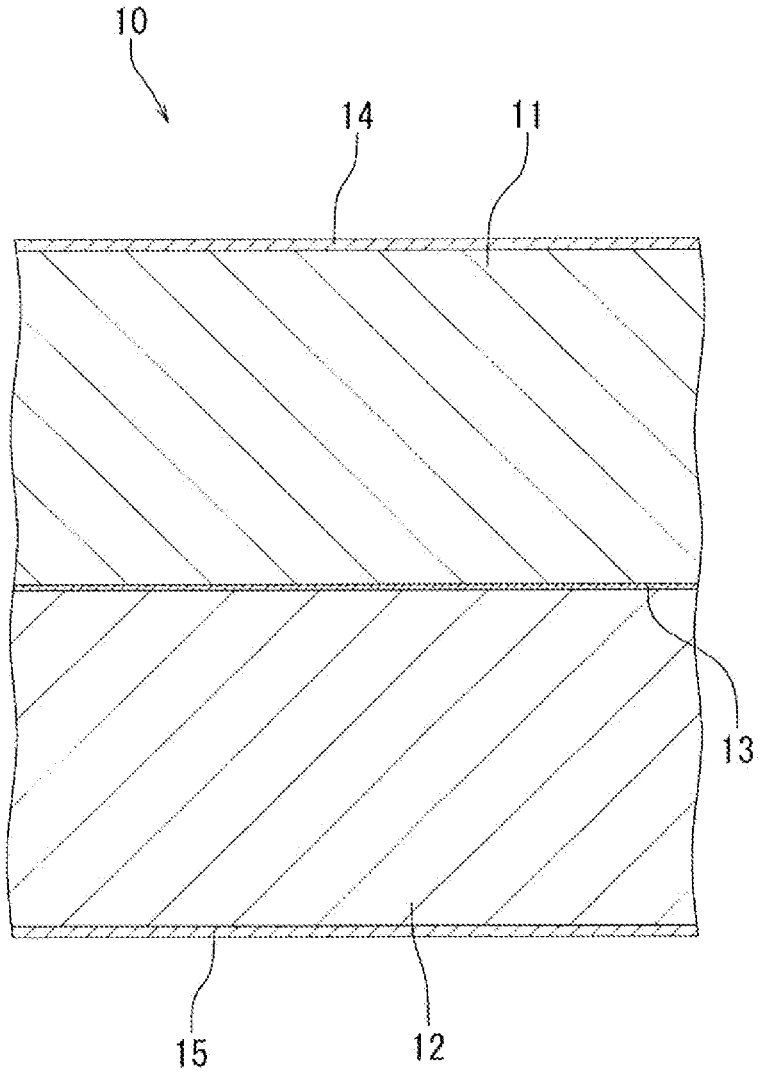
FIG. 3 is a sectional view of another example of the sound absorbing member lamination structure according to the embodiment of the present invention.

In the sound absorbing member lamination structure according to the embodiment, the interposition 13 has a structure in which a plurality of through-holes having a larger size of an opening in comparison with the thickness of thereof, are arranged. However, the present invention is not limited only to such an embodiment and when there is placed a larger emphasize on the reflection of the sound than the sound passing through the interposition, there may be applied a structure in which the interposition 17 has no holes as shown in FIG. 3, thus making it possible to obtain desired reflection properties of the sound as the whole of the laminate and perform the sound field adjustment in accordance with the use.

In the sound absorbing member lamination structure according to the embodiment as described above, the interposition 13 is in a form of a flexible thin sheet. However, the present invention is not limited only to such an embodiment and the interposition may be in a form of a non-flexible thin sheet to improve a non-flexibility in the laminated state, thus making it possible to handle the laminate as a not-easily deformable panel so as to be propped against the wall, etc. when placing the panel, and maintain the propped state, and making it possible to provide a further easy handling in accordance with use.

In the sound absorbing member lamination structure according to the embodiment as described above, there is applied a structure in which, when a music instrument that is played by a player as an object person serves as the sound source, the sound absorbing member may change a state in which the reflected sound in the room space of the sound generated by such a music instrument reaches the player so as to adjust the sound field, thus making it possible for the player to make a practice of performance with the similar sound field to the live performance stage. However, the present invention is not limited only to such an embodiment and there may be applied a structure in which the sound absorbing member is placed, in the vicinity of an object person who is neither a player nor a singer, against the sound source which is neither the music instrument, nor the singer oneself, in a place apart from the above-mentioned object person, so as to change the state in which the reflected sound in the room space reaches the object person, thus adjusting the sound field for the object person. The apparatus of the present invention makes it possible for the object person who is neither the player, nor the singer, to listen, for example even in a room, to the performance or singing by the other person and the sound or voice outputted from the loudspeaker, while obtaining the sound field which is similar to the hall.

EXAMPLE

Description will be given of confirmation as whether or not the sound absorbing member lamination structure of the present invention provides a sufficient strength by which the structure may bear the usage, through the lamination by the pressure-sensitive adhesive, as well as of results of measurement assessment for the reflected sound generated, after receipt of the sound as generated from the sound source, by the laminate as actually used for the sound field adjustment, to which the sound absorbing member lamination structure of the present invention is applied.

First, the felt as the sound absorbing member was bonded to the other layer by the pressure-sensitive adhesive. The pulling force was applied to the felt, and the bonding state of the felt and the other layer by adhesion was observed and there was made an assessment of the adhesive power of the pressure-sensitive adhesive for maintaining the laminated state.

There were used two kinds of pressure-sensitive adhesive, i.e., with strong and weak adhesive powers in a state in which they expressed the adherence property, respectively. Both of them were an acrylic pressure-sensitive adhesive that had a property by which they may be shifted from a state of liquid pressure-sensitive adhesive composition in which the adherence property has not as yet been expressed to a state in which the adherence property has already been expressed through loss of liquid component so that it became the pressure-sensitive adhesive as intended.

A plate was used as the other layer, which was to be laminated with the felt as the sound absorbing member. Concerning each case of the above-indicated two kinds of pressure-sensitive adhesive, the pressure-sensitive adhesive composition, which was in a form of liquid and did not express the adherence property, was applied on the surface of the plate, and a part of the pressure-sensitive adhesive composition as applied was shifted into a state in which the adherence property has been expressed, and then the felt was placed on the plate. Then, a sufficient period of time passed, leading to a state in which the pressure-sensitive adhesive composition has been deemed as having completely expressed the adherence property to become the pressure-sensitive adhesive as intended, and this pressure-sensitive adhesive has been deemed as bonding the felt and the plate integrally with each other. Then, the pulling force for peeling off the felt from the plate was applied to the felt by a hand.

Figure 4:
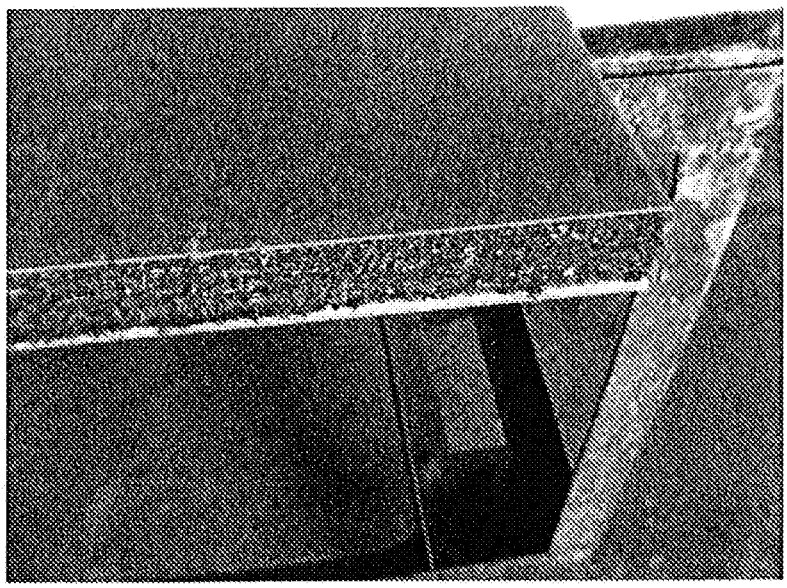
FIG. 4 is a descriptive view illustrating a state in which a pulling force is started to be applied to the felt adhered by a pressure-sensitive adhesive as used in the sound absorbing member lamination structure of the present invention.
Figure 4:
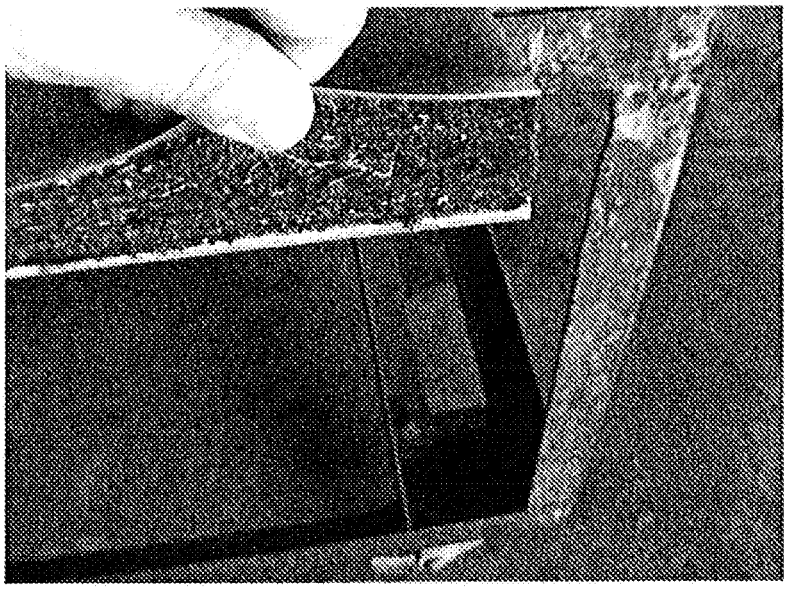
Figure 5:
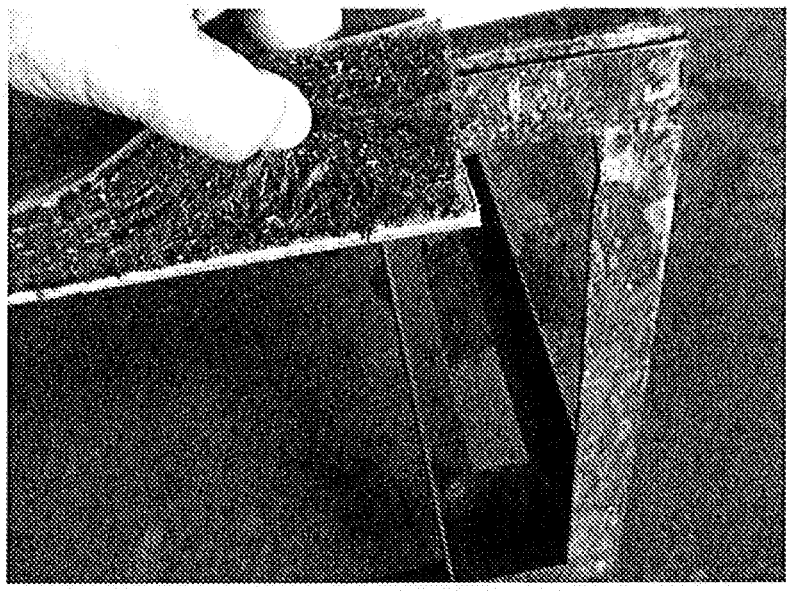
FIG. 5 is a descriptive view illustrating a broken state by the pulling force applied to the felt adhered by a pressure-sensitive adhesive as used in the sound absorbing member lamination structure of the present invention.
Figure 5:
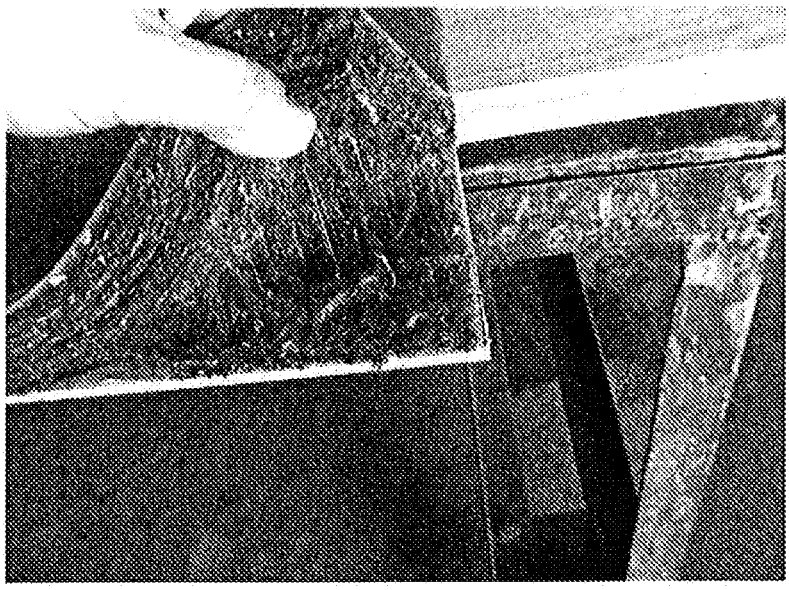
Figure 6:
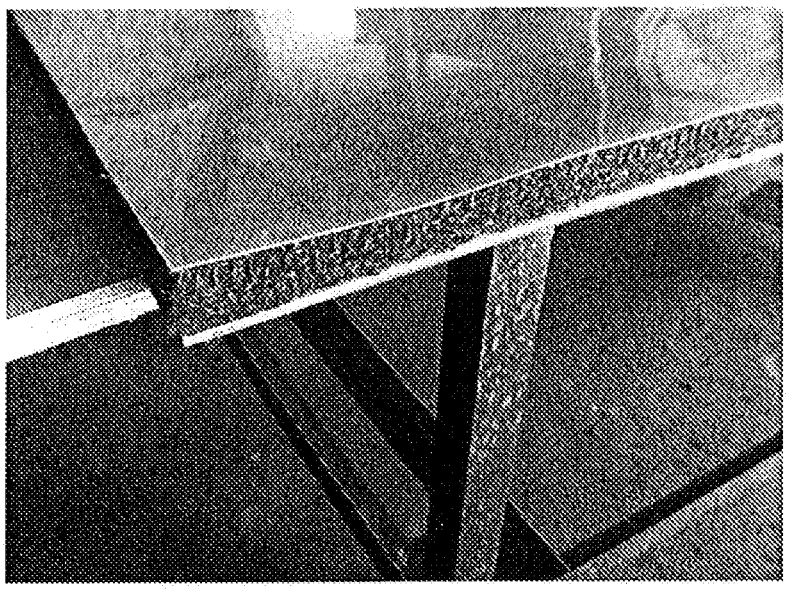
FIG. 6 is a descriptive view illustrating a state in which a pulling force is started to be applied to the felt adhered by the other kind of adhesive.
Figure 6:
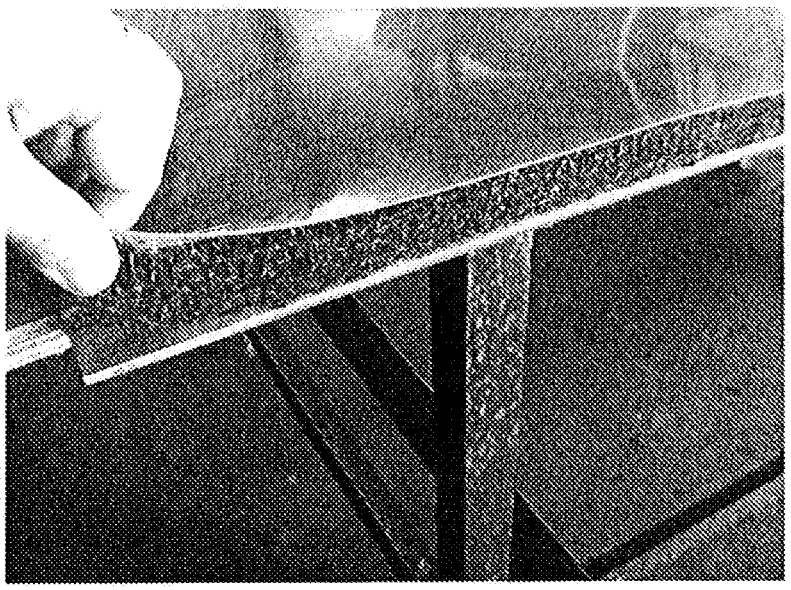
Figure 7:
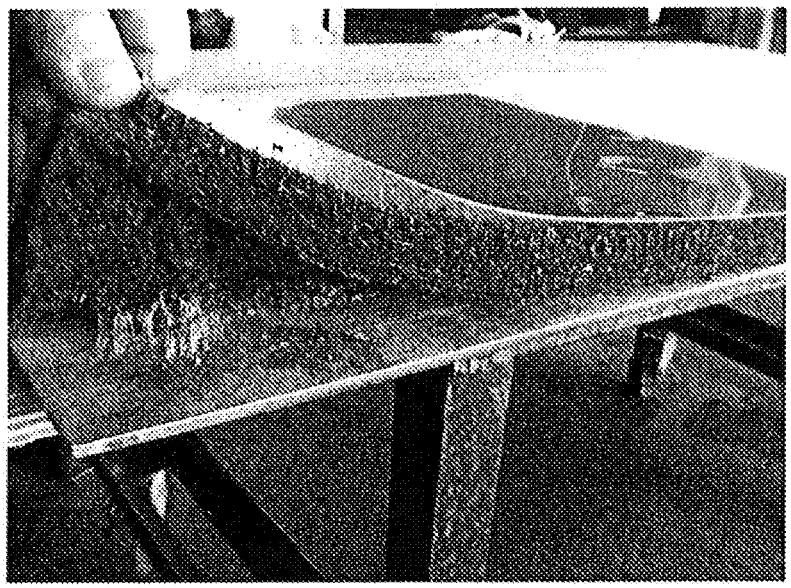
FIG. 7 is a descriptive view illustrating a peeled-off state by the pulling force applied to the felt adhered by the other kind of adhesive.
Figure 7:
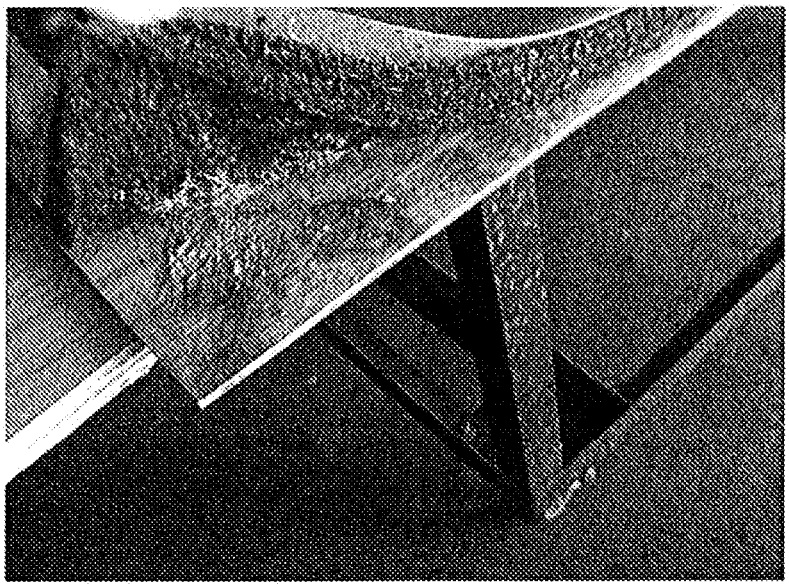

FIG. 4 and FIG. 5 show the state in which the pulling force was applied to the felt, which was bonded by the pressure-sensitive adhesive having a strong adhesive power, and FIG. 6 and FIG. 7 show the state in which the pulling force was applied to the felt, which was bonded by the pressure-sensitive adhesive having a weak adhesive power.

As shown in FIG. 5, in a case where the pressure-sensitive adhesive having the strong adhesive power was used, application of the pulling force to the felt provided a state in which a part of the felt pulled by the hand was peeled off from the portion as adhered to the plate and the part of the felt was separated. The part of the felt as separated was kept as being bonded to the plate. It apparently revealed that, even when the pulling force to release combination of fiber elements of the felt itself was applied, the pressure-sensitive adhesive bonded the felt and the plate together by the adhesive power that was larger than the pulling force. The whole of the laminate was considered as being handled in a manner not to deteriorate the shape of the felt. Therefore, it might be said that the laminated layers using such a pressure-sensitive adhesive had a sufficient strength.

On the other hand, as shown in FIG. 7, in a case where the pressure-sensitive adhesive having the weak adhesive power was used, application of the pulling force to the felt provided a state in which felt was peeled off from the plate. It revealed that the adhesive power of this pressure-sensitive adhesive did not bear even the pulling force, which was too small to release combination of fiber elements of the left layer itself, thus being difficult to maintain the combined state of the felt and the plate. When such a pressure-sensitive adhesive was used, it was capable of being used only in a case where a force applied externally was sufficiently small.

Then, the laminate having the sound absorbing member lamination structure of the present invention was placed in a room space for test, and there was measured a sound pressure level in each frequency of the reflected sound from the laminate, when the sound was outputted from the sound source. The bodies, in which the above-mentioned pressure-sensitive adhesive having the strong adhesive power and the pressure-sensitive adhesive having the weak adhesive power were used respectively, were placed in the room space and the measurement was made in the same manner.

In each case, the laminate was obtained by placing the extremely thin sheet-shaped interposition between the felts as the sound absorbing member, placing a cloth as one of the covering for covering the surface of the felt and a sheet formed of EVA resin as the other thereof, and applying the pressure-sensitive adhesive to between the respective layers, thus providing the body as laminated integrally with each other. It had a size of about 900 mm×1800 mm and a thickness of about 21 mm.

However, in case where the above-mentioned pressure-sensitive adhesive having the strong adhesive power was used, the pressure-sensitive adhesive composition, which was in a form of liquid, was applied only on the interposition and the respective coverings in the bonding of the felt as the sound absorbing member and the other layer during a lamination process, and they were adhered to the sound absorbing member into a laminated state. On the other hand, in case where the above-mentioned pressure-sensitive adhesive having the weak adhesive power was used, the pressure-sensitive adhesive composition, which was in a form of liquid, was applied not only on the interposition and the respective coverings, but also on the surface of the felt in the bonding of the felt as the sound absorbing member and the other layer during a lamination process, and they were adhered into a laminated state so as to cause the adhesive power to be generated surely between the respective layers.

For the measurement, the sound source was placed around the center of the space, the laminate was placed along the surface of the wall, a microphone was placed in the vicinity of the surface of the other wall on which the laminate was not placed, and sine-wave basic sounds of 80 Hz, 250 Hz, 400 Hz and 2000 Hz were outputted from the sound source in the direction to the laminate, and the respective reflected sounds were measured. After measurement, the frequency components (the frequency spectrum) were determined from the time waveform through the fast Fourier transformation.

Figure 8:
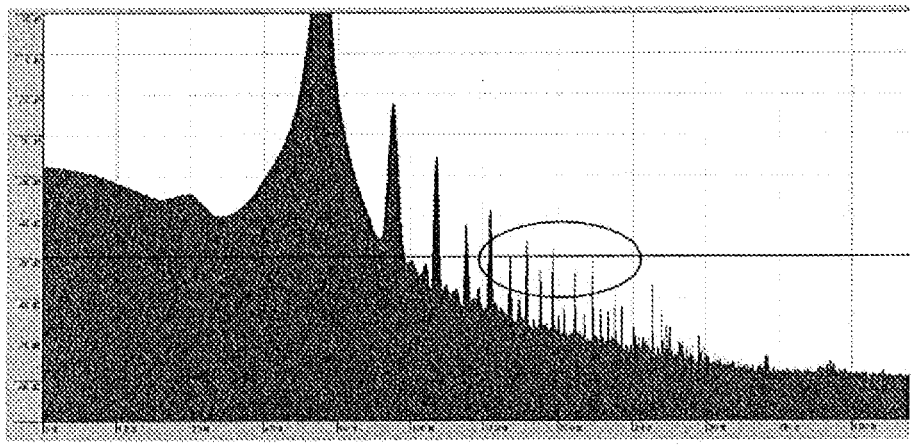
FIG. 8 is a graph illustrating frequency components of respective reflected sounds, relative to basic sounds of 80 Hz and 250 Hz, which has been reflected by a laminate obtained by laminating layers by the pressure-sensitive adhesive used in the sound absorbing member lamination structure of the present invention.
Figure 8:
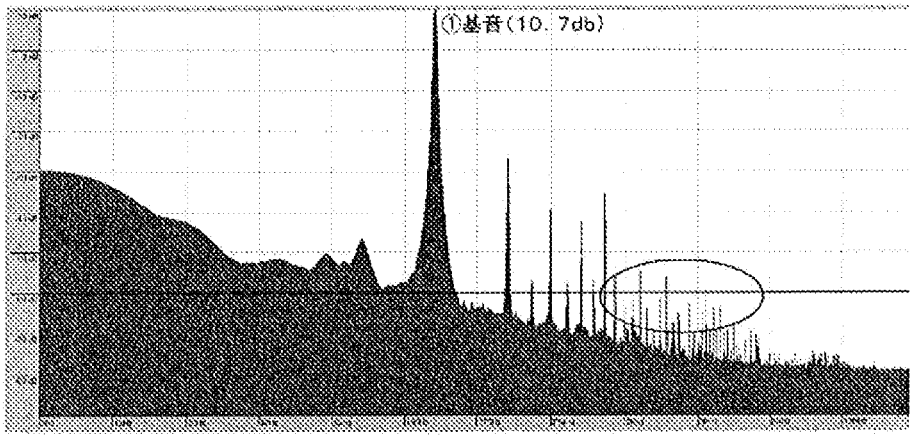
Figure 9:
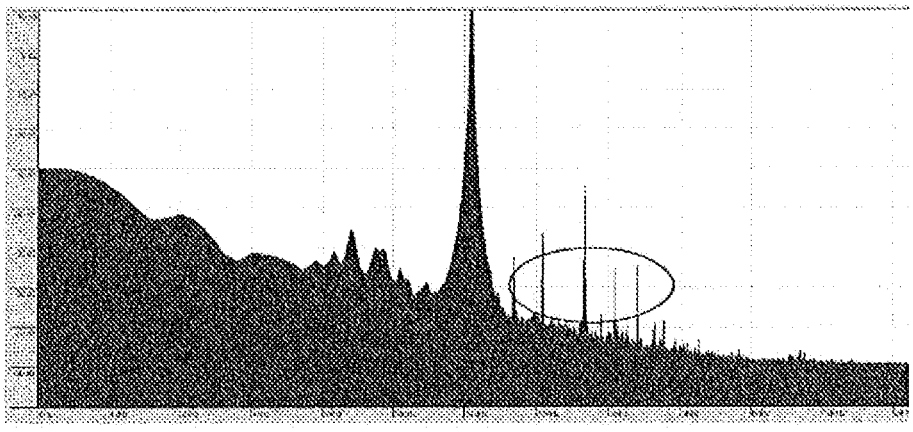
FIG. 9 is a graph illustrating frequency components of respective reflected sounds, relative to basic sounds of 400 Hz and 2000 Hz, which has been reflected by the laminate obtained by laminating layers by the pressure-sensitive adhesive used in the sound absorbing member lamination structure of the present invention.
Figure 9:
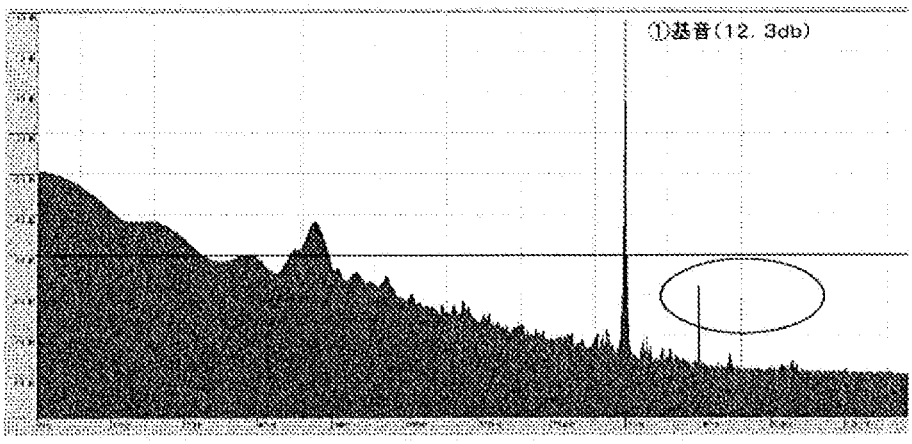
Figure 10:
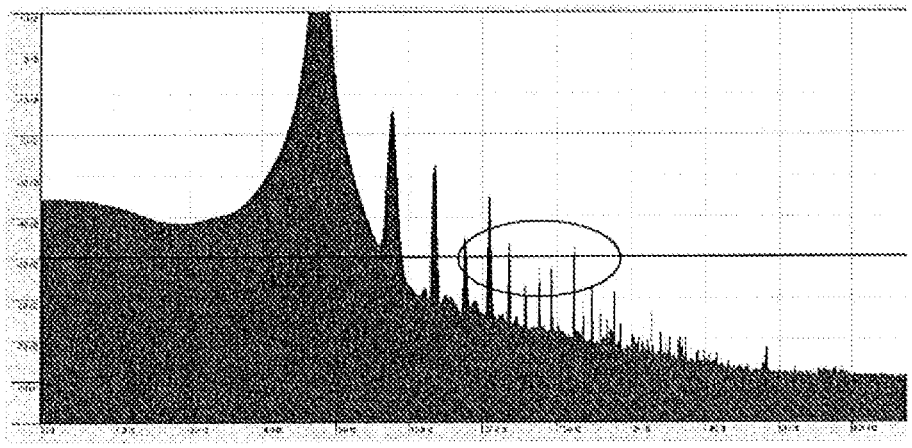
FIG. 10 is a graph illustrating frequency components of respective reflected sounds, relative to basic sounds of 80 Hz and 250 Hz, which has been reflected by a laminate obtained by laminating layers by the other kind of adhesive.
Figure 10:
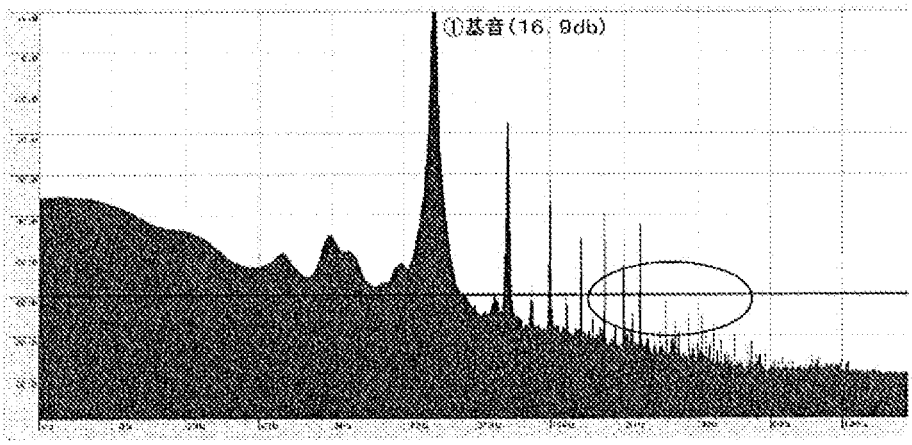
Figure 11:
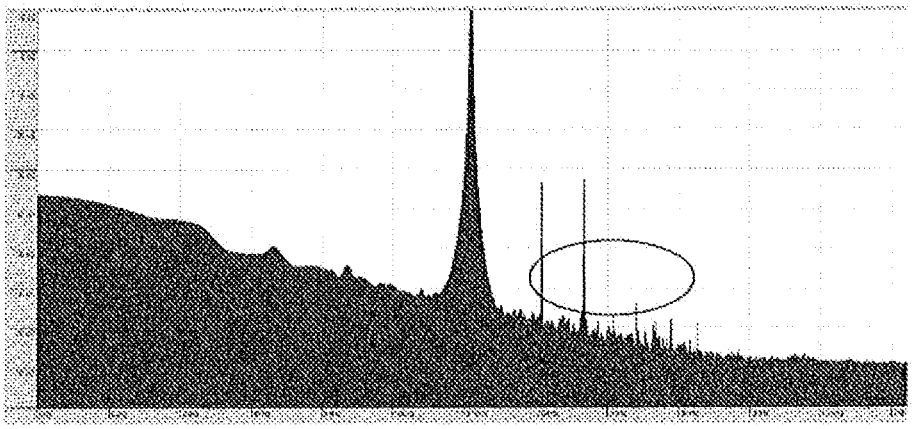
FIG. 11 is a graph illustrating frequency components of respective reflected sounds, relative to basic sounds of 400 Hz and 2000 Hz, which has been reflected by the laminate obtained by laminating layers by the other kind of adhesive.
Figure 11:
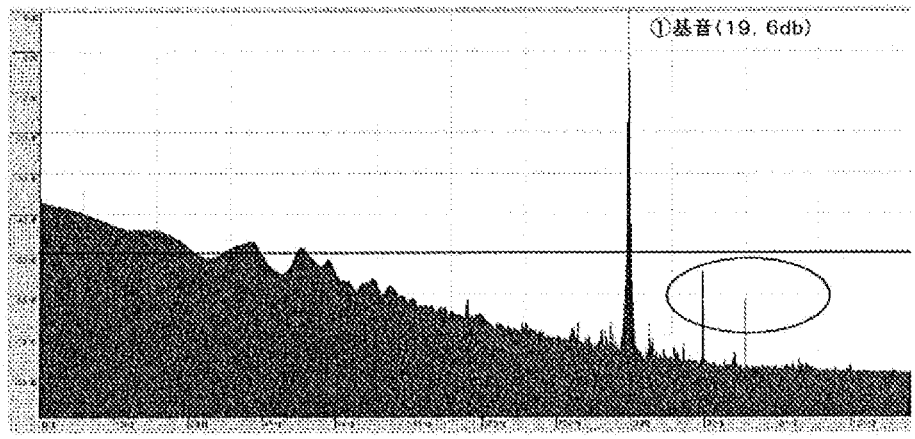

FIG. 8 and FIG. 9 show graphs of the sound pressure levels for each frequency on the respective basic sounds, obtained by the measurement in the case where the laminate using the above-mentioned pressure-sensitive adhesive having the strong adhesive power was placed in the room space, as Example 1. FIG. 10 and FIG. 11 show graphs of the sound pressure levels for each frequency on the respective basic sounds, obtained by the measurement in the case where the laminate using the above-mentioned pressure-sensitive adhesive having the weak adhesive power was placed in the room space, as Example 2. In each graph, an axis of abscissas indicates a frequency, an axis of ordinate, a sound level. However, the room space as the measurement environment was not an anechoic and complete sound isolation structure, background noise existed.

The sound levels of the basic sound frequency for the reflected wave were 24.5 dB in 80 Hz, 10.7 dB in 250 Hz, 19.9 dB in 400 Hz and 12.3 dB in 2000 Hz, in Example 1. They were 24.5 dB in 80 Hz, 16.9 dB in 250 Hz, 19.9 dB in 400 Hz and 19.6 dB in 2000 Hz, in Example 2.

It is revealed from the respective drawings that, in case of Example 1, the harmonic sound in high order, which constitutes the base of the natural sound, appears smoothly in comparison with the case of Example 2, and there is provided a state in which the level decreases with increased frequency with a natural and reasonable attenuation (80 Hz, 250 Hz, 400 Hz) or a state in which the harmonic sound in high order appropriately appears with increased level of the reflected sound of the basic sound (250 Hz, 2000 Hz). More specifically, it is revealed that the laminate of Example 1 inhibits the useless reflection and provided an appropriate sound absorption so as to make the sound field adjustment by which the properties for providing a natural quality in the room space can be obtained.

Especially, Example 1 differs from Example 2 in that the pressure-sensitive adhesive composition is not applied to the sound absorbing member side. It is therefore considered that there is a less restriction at the boundary between the sound absorbing member and the other layer, the sound absorption performance can be achieved more effectively and appropriately, there is no occurrence of the useless reflection to cancel the harmonic sound components each other, and the harmonic sound components in high order remain and the level of the reflected sound of the basic sound is controlled.

It is apparent from these matters that application of the sound absorbing member lamination structure of the present invention permits to control an influence by the useless reflection of the sound to make an appropriate sound field adjustment, thus making it possible to provide a person with an excellent sound field with the natural quality.

REFERENCE SIGNS LIST

10 laminate
11, 12 felt
13, 17 interposition
13*a* hole
14, 15 covering
16 pressure-sensitive adhesive

What is claimed is:

1. A sound absorbing member lamination structure, in which one or more sound absorbing members and at least one of one or more interpositions and a surface covering are laminated into a united body, wherein:

said interposition is in a form of a flexible thin sheet or a non-flexible thin sheet;

the sound absorbing members, which are substantially in a form of a porous sheet, and said interposition are laminated by applying a pressure-sensitive adhesive composition, which is in a form of liquid and does not express an adherence property, on one or both of said sound absorbing member and interposition, and by placing the interposition between the sound absorbing members; and said pressure-sensitive adhesive composition as applied converts into an intrinsic pressure-sensitive adhesive to express the adherence property so that said intrinsic pressure-sensitive adhesive adheres to each of said sound absorbing members and interposition to combine the sound absorbing members and interposition into a united body, wherein:

said interposition defining a thickness that is less than a thickness defined by said sound absorbing member and has a plurality of through-holes formed at predetermined intervals, said through-holes having a larger size of an opening in comparison with a thickness of the interposition and enabling the sound absorbing members, between which the interposition is placed, to come into direct contact with each other;

the pressure-sensitive adhesive composition is also provided on surface portions of the sound absorbing members, which overlap with each other in a position of the hole of said interposition in a laminated state; and the sound absorbing members are adhered into a united body in the position of each of the holes of said interposition in the laminated state.

2. The sound absorbing member lamination structure, as claimed in claim 1, wherein:

said sound absorbing member is formed of felt; and said pressure-sensitive adhesive has an adhesive power which maintains an adhered state to the sound absorbing member against a minimum pulling force which is applied externally and permits release of a combination of fiber elements constituting the sound absorbing member.

3. The sound absorbing member lamination structure, as claimed in claim 1, wherein:

a pressure-sensitive adhesive composition in a form of liquid is applied on the interposition when said sound absorbing members and interposition are laminated, to prevent the pressure-sensitive adhesive composition from penetrating into the sound absorbing member; and the pressure-sensitive adhesive, which has expressed the adherence property, is caused to exist between the sound absorbing members and interposition as laminated so as to be placed only in an outermost portion of a porous structure of the sound absorbing member.

4. The sound absorbing member lamination structure, as claimed in claim 2, wherein:

a pressure-sensitive adhesive composition in a form of liquid is applied on the interposition when said sound absorbing members and interposition are laminated, to prevent the pressure-sensitive adhesive composition from penetrating into the sound absorbing member; and the pressure-sensitive adhesive, which has expressed the adherence property, is caused to exist between the sound absorbing members and interposition as laminated so as to be placed only in an outermost portion of a porous structure of the sound absorbing member.

* * * * *